United States Patent [19]

Payne

[11] 4,266,655

[45] May 12, 1981

[54] APPARATUS FOR PHASING AND TRANSFERRING ROD-SHAPED ARTICLES

[75] Inventor: Leslie E. Payne, Winston-Salem, N.C.

[73] Assignee: R. J. Reynolds Tobacco Company, Winston-Salem, N.C.

[21] Appl. No.: 970,424

[22] Filed: Dec. 18, 1978

[51] Int. Cl.[3] ..... B65G 37/00; B65G 29/00

[52] U.S. Cl. ..... 198/461; 198/597; 198/481

[58] Field of Search ..... 198/482, 481, 461, 462, 198/597, 450, 611, 608, 599, 635, 637, 488

[56] References Cited

U.S. PATENT DOCUMENTS

| | | | |
|---|---|---|---|
| 2,355,100 | 8/1944 | Nordquist . | |
| 3,158,251 | 11/1964 | Skala et al. . | |
| 3,380,459 | 4/1968 | Schmermund . | |
| 3,405,579 | 10/1968 | London | 198/450 |
| 3,412,842 | 11/1968 | Molins . | |
| 3,901,373 | 8/1975 | Rudzinat . | |
| 3,957,152 | 5/1976 | Heitmann . | |
| 3,957,154 | 5/1976 | Shiba | 198/481 |
| 4,003,277 | 1/1977 | Oesterling | 198/450 |
| 4,032,000 | 6/1977 | Leclerc et al. . | |

*Primary Examiner*—Joseph E. Valenza
*Assistant Examiner*—Brian Bond
*Attorney, Agent, or Firm*—Grover M. Myers

[57] ABSTRACT

A transfer and phasing device having a transfer drum for receiving rod-shaped articles from an output drum rotating at the same peripheral speed, a phasing drum rotating at a different peripheral speed and having a plurality of tapered seats for receiving the rod-shaped articles from the transfer drum, and means for capturing and moving said rod-shaped articles into said tapered seats.

6 Claims, 5 Drawing Figures

APPARATUS FOR PHASING AND TRANSFERRING ROD-SHAPED ARTICLES

BACKGROUND OF THE INVENTION

This invention relates to an apparatus for phasing and transferring rod-shaped articles between conveying drums which are rotating at different peripheral speeds, and, more particularly, a device for phasing and transferring cigarettes between two vacuum drums having different peripheral rotational speeds.

Traditionally, in the tobacco industry, during the manufacture of cigarettes, the cigarettes are conveyed on the machinery from one point to another by rotating drums which have a plurality of recessed seats or pockets on their peripheral surface. A vacuum or negative pressure system is used to hold the cigarettes on the seats as the drums rotate. Each cigarette is retained in a fixed position on the drum by using the vacuum; and, upon transfer, the vacuum on the carrying drum is terminated and the vacuum on the pick-up drum is initiated.

In many instances, the drums are of different diameters; and, although the angular speed of the drums may differ, the peripheral speed of the surface of the drum must be the same and each drum must be phased relative to the other drums in order for the cigarettes to be transferred between the drums. This phasing can be done relatively easy if all drums are driven by the same source.

A problem occurs, however, when the drums are being driven from two different sources. Phasing the drums becomes very difficult and mechanically keeping the drums in synchronization is almost impossible.

In most instances, it is possible to drive all of the conveying drums from the same source; however, there are situations when two driving sources are advantageous—for example, where it is desirable not to interrupt the final processing operation should the initial processing operation cease to function. One such situation is illustrated in my co-pending U.S. patent application Ser. No. 859,615 filed Dec. 12, 1977 and entitled METHOD AND APPARATUS FOR PERFORATING AN ASSEMBLED FILTER USED ON A SMOKING PRODUCT.

The forming drum illustrated in this co-pending application usually requires heat to form the holes in the cigarette filters. If the forming drum were connected directly to the filter cigarette assembler drive mechanism and a problem were encountered in the assembly phase of the operation producing or requiring a stoppage, the forming drum would also stop. If such a stoppage occurs, the forming drum would contain cigarettes at various stages of formation. Some of the filters would have heated piercing members inserted therein. As is set forth in my earlier application, the time period for applying the heated piercing members to the filters has to be precisely controlled, otherwise, the holes will not be uniform in shape to produce the proper air dilution flow through the filter.

To insure that the heat is applied for the proper period of time, it is essential to remove the cigarettes in the forming drum should a stoppage in the initial operation stage of the assembler occur. The most logical way to accomplish this objective is to have a separate drive source for the forming drum which would cause the forming drum to continue to operate even when the assembler stops. Since it is almost impossible to mechanically maintain two driving sources in phase, there exists a need for a phasing and transferring apparatus which will allow the transferring of cigarettes between conveying drums operating at different peripheral speeds produced by using separate driving sources.

SUMMARY OF THE INVENTION

It is, therefore, an object of this invention to provide a phasing and transferring apparatus which will permit the transfer of rod-shaped articles between conveying drums with a differential in their peripheral speed.

Another object of this invention is to provide a transfer device which will permit the transferring of rod-shaped articles between drums which are not synchronized.

Still another object of this invention is to provide a phasing and transferring apparatus which will permit one machine running at a constant speed to be connected to another machine which will run from zero speed to a speed equivalent to the first machine.

Still another object of this invention is to provide a phasing and transferring apparatus which can connect a first and second machine driven by two different sources and which will permit the second machine to continue to function if the first machine encounters a stoppage.

These and other objects are accomplished by the present invention through the use of a transfer drum driven by a first source. The transfer drum receives rod-shaped articles from an out-put drum of a first machine driven by the first source. A phasing drum driven by a second source receives the rod-shaped articles from the transfer drum. A driven retaining belt circumscribing portions of both transfer and phasing drums retains the rod-shaped articles on the phasing drum. The retaining belt is positioned below the rod-shaped articles while they are on the transfer drum and, upon transfer of the articles to the phasing drum, the belt is located above the articles. The belt is not only used to initially retain the articles on the phasing drum, but also to move the articles on the surface of the phasing drum until they are captured by vacuum seats on the phasing drum. The speed of the retaining belt is slightly less than the peripheral speed of the phasing drum. The rod-shaped articles are transferred from the phasing drum to the input drum for a second machine which is driven by the second source.

BRIEF DESCRIPTION OF THE DRAWINGS

The foregoing and additional objects, features and advantages of the present invention will be apparent to those skilled in the art from the following detailed description of a preferred embodiment, taken with the accompanying drawings, in which.

DESCRIPTION OF A PREFERRED EMBODIMENT

Figure 1:
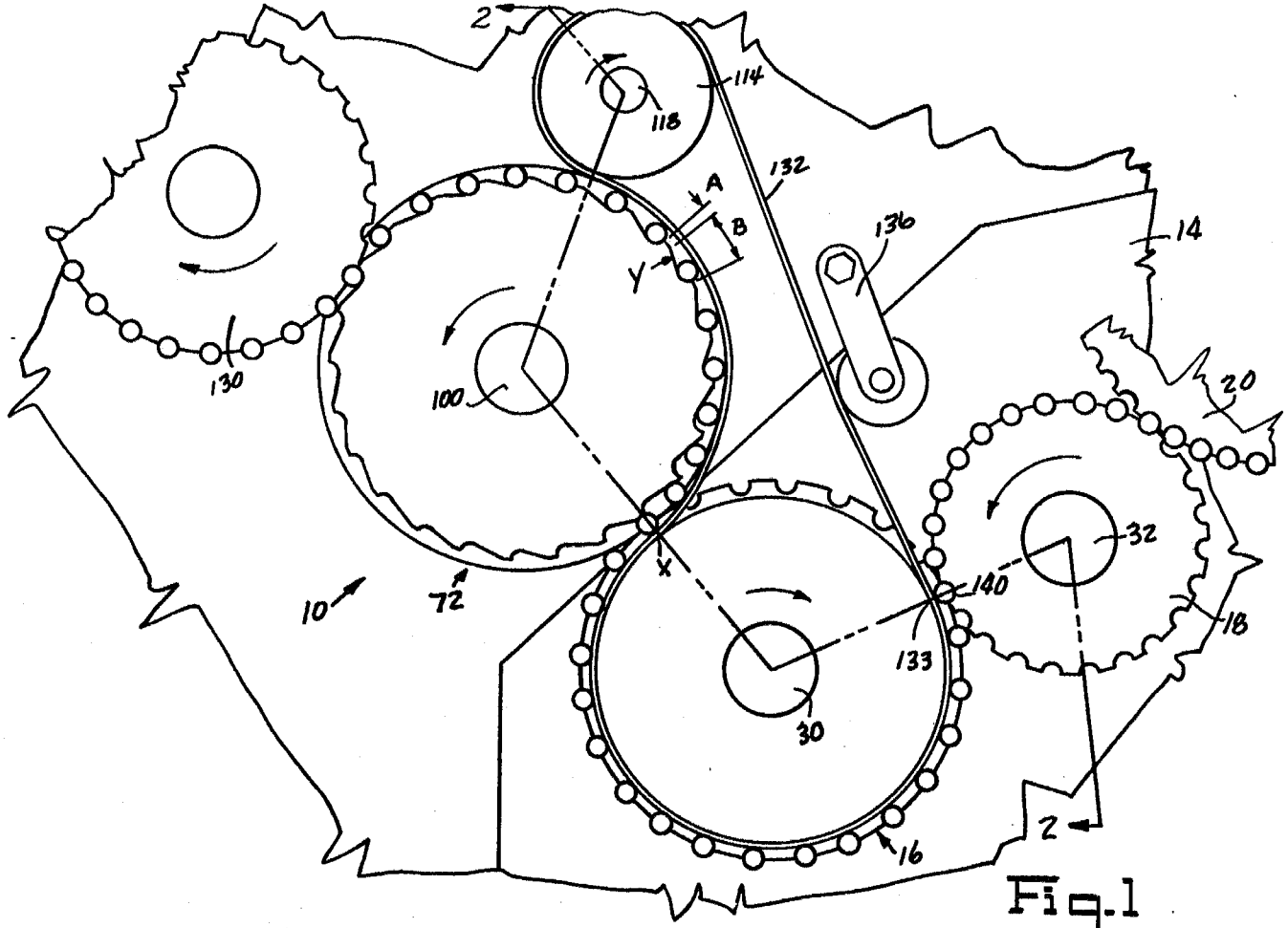
FIG. 1 is a front schematic view of the transferring and phasing device according to the present invention.

Referring more particularly to the drawings, in FIG. 1, the numeral 10 indicates a transfer and phasing apparatus for conveying rod-shaped articles (i.e., cigarettes, filter rods, etc.) from one drum to another which are rotating at different peripheral speeds. The transfer and phasing apparatus are secured to mounting plates 12 and 14 which are suitably secured to the frame of two machines between which the rod-shaped articles are to be transferred (see FIGS. 1 and 2). The transfer drum 16 receives cigarettes from an output drum 18 of the first machine 20.

The output drum 18 and the transfer drum 16 have cylindrical drum shaft housings 17 and 15, respectively, which are suitably secured to top plate 22 of a gear housing 24 by bolts 26. The gear housing 24 is, in turn, suitably secured to the mounting plate 14 and has an H-shaped cross section (see FIG. 2) with a cross plate 28. Shafts 30 and 32 of the transfer drum 16 and output drum 18 are suitably journaled near their rear ends in bearings 34 and 36 carried in the rear end of the housings 15 and 17, respectively; the housing extending through apertures in cross plate 28. The forward ends of the shaft 30 and 32 are journaled in bearings 38 and 40, respectively, positioned in annular grooves in the forward ends of the cylindrical housings 15 and 17 and shaft heads 42 and 44, respectively. Retaining means 46 and 48 are provided on the shafts to aid in retaining the bearings in position.

Looking more particularly at output drum 18, the rear end of the shaft 32 carries a gear 50 located between cross plate 28 and mounting plate 14 which abuts the rear of bearing 36 and is held on the shaft by a nut 52. The shaft 32 extends through an aperture 54 in mounting plate 14 and is driven in a suitable manner by the drive (not shown) of the first machine 20, such as a cigarette filter assembler. Attached to the forward end of shaft 32, by bolt 56 is a generally cylindrical-shaped sleeve 58 having a plurality of seats or pockets 60 attached to or formed in its peripheral surface. The inner surface of sleeve 58 contacts the outer surface of housing 17 and will slip over the housing when shaft 32 rotates. The seats on sleeve 58 are uniformly spaced around the circumference and carry the rod-shaped articles. The drum 18 has a negative pressure or vacuum system which holds the cigarettes in the seats as will be described hereinafter.

Transfer drum 16 is driven by output drum 18 through gear 50 on shaft 32 which meshes with a gear 62 (located between plates 28 and 14) carried on the end of shaft 30. The hub of gear 62 abuts the rear of bearing 34 and is held on the shaft by nut 64. The head 42 of shaft 30 carries seat sleeve 66 secured thereto by bolts 68. The seat sleeve is similar to the seat sleeve 58 except for the larger center seat portion 70 and annular pulley rings 142 and 144 carried thereon. The inner surface of seat sleeve 66 contacts the outer surface of housing 15 and will slip over the housing as shaft 30 rotates. Drum 16 has a vacuum system to hold the rod-shaped articles in the seats after transfer from the output drum 18.

Adjacent to transfer drum 16 is phasing drum 72. Phasing drum 72 has a stationary cylindrical housing 74 which extends through an aperture in mounting plate 12 and is suitably secured thereto by bolt 76. The rear end 77 of housing 74 extends to and slightly through an aperture in a support plate 78. The support plate is part of a gear housing 80 which also includes a side plate 82 to which support plate 78 is fastened and a cover plate 84.

A shaft 86 extends through housing 74 and is journaled in the rear end 77 of the housing 74 by bearing 88 carried in a groove 90 in the end of the housing. A drive gear 92 is secured to the end of the shaft 86 and abuts bearing 88 holding it in place. The forward end of the shaft 86 is journaled in the forward end of housing 74 by bearing 94 carried in grooves 96. The bearing is retained by ring 98 which is suitably attached to the end of the housing. The shaft head 100 carries a drum sleeve 102 having a seat portion 104. The inner surface of the sleeve contacts the outer surface of housing 74 and slips over housing as the shaft 82 rotates. The phasing drum also has a vacuum system which holds the rod-shaped articles on the drum.

Figure 3:
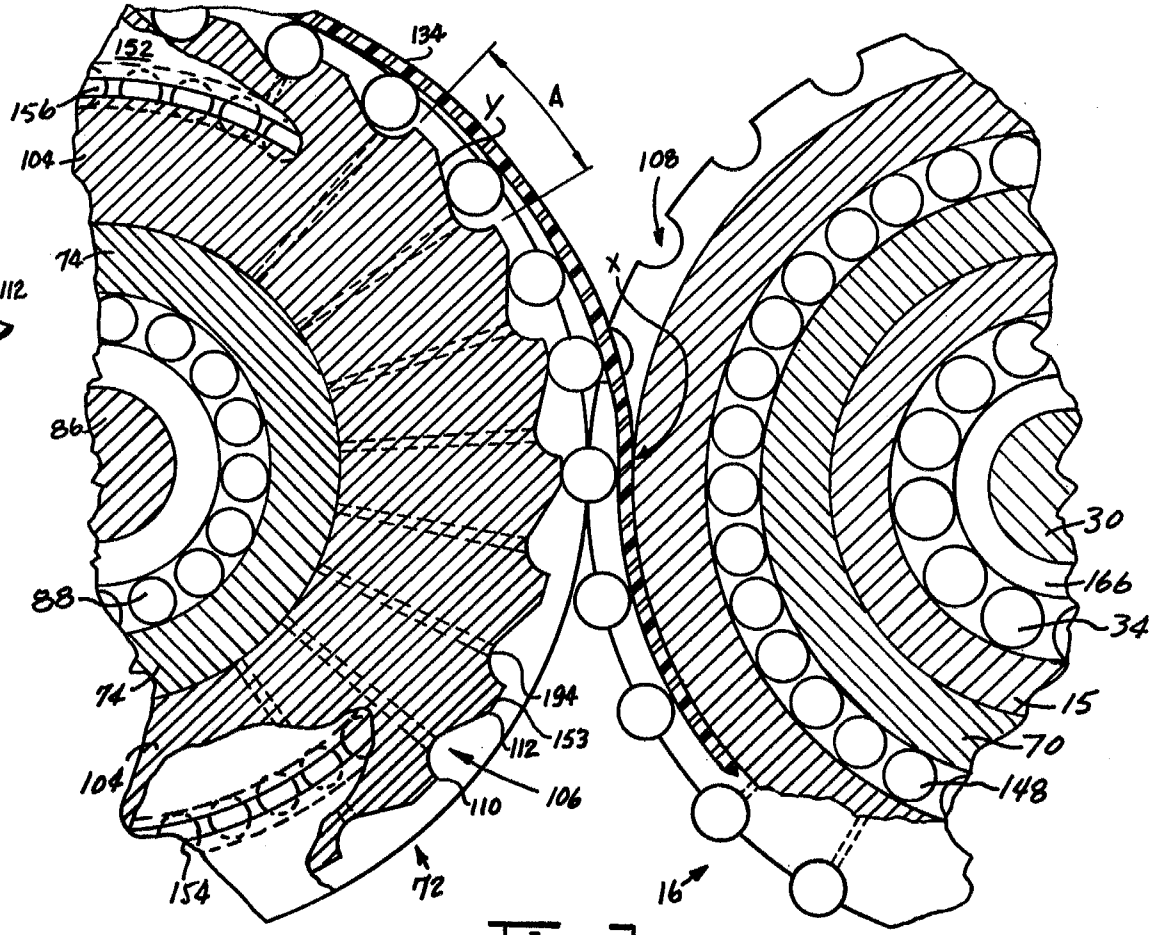
FIG. 3 is a partial detail of the transfer and phasing drums illustrating the point of transfer according to the present invention.
Figure 4:
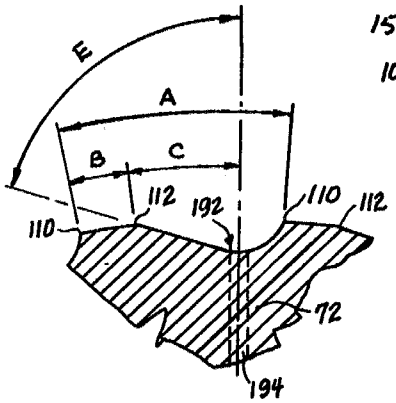
FIG. 4 is a cross-section taken along Lines 4—4 of FIG. 2.

As can be seen in FIGS. 3 and 4, the seats, pockets or flutes 106 of the phasing drum 72 have a different configuration than pockets 108 of the transfer drum. Pockets 108 have a semi-circular shape as is standard and known in the art, while the pockets 106 of the phasing drum have what will be referred to herein as a tapered configuration. In order to describe the pockets, it will be necessary to define and orient the pocket in the figures. As can be seen in FIG. 3, in this preferred embodiment, the phasing drum 72 rotates in a counterclockwise direction, thus, the pocket will have a trailing side 110 and a leading side 112. The specific dimension and purpose of this tapered configuration of pocket 106 will be explained below after the description of the retaining belt which follows.

Positioned adjacent to phasing drum 72 are driven pulleys 114 and 116 (see FIGS. 1 and 2) which are suitably secured to pulley shaft 118 in a spaced relationship on opposite sides of the seat portion 104 of drum sleeve 102. Shaft 118 is journaled in forward and rear bearings 120 and 122, respectively, which are carried in grooves in the forward and the rear end of cylindrical housing 124. Housing 124 is secured to mounting plate 12 by bolts 126 and extends through an aperture in plate 112 and support plate 78. The end of the shaft 118 carries a gear 128 which meshes with and is driven by gear 72 on the phasing drum shaft 86.

Also positioned adjacent to the phasing drum 72 is an input drum 130 for receiving the rod-shaped articles from the phasing drum and infeeding them into the second machine. The second machine drives drum 130 which has a gear 131 that meshes with gear 92 on the phasing drum drive shaft. Since the input drum 130 drives the phasing drum, the peripheral speeds of the drums can be matched and maintained. The input drum is similar to output drum 18 which are known in the art, therefore, no further description of this drum is deemed necessary. Input drum 130 can be part of the second machine or part of the transfer and phasing system described herein.

Figure 2:
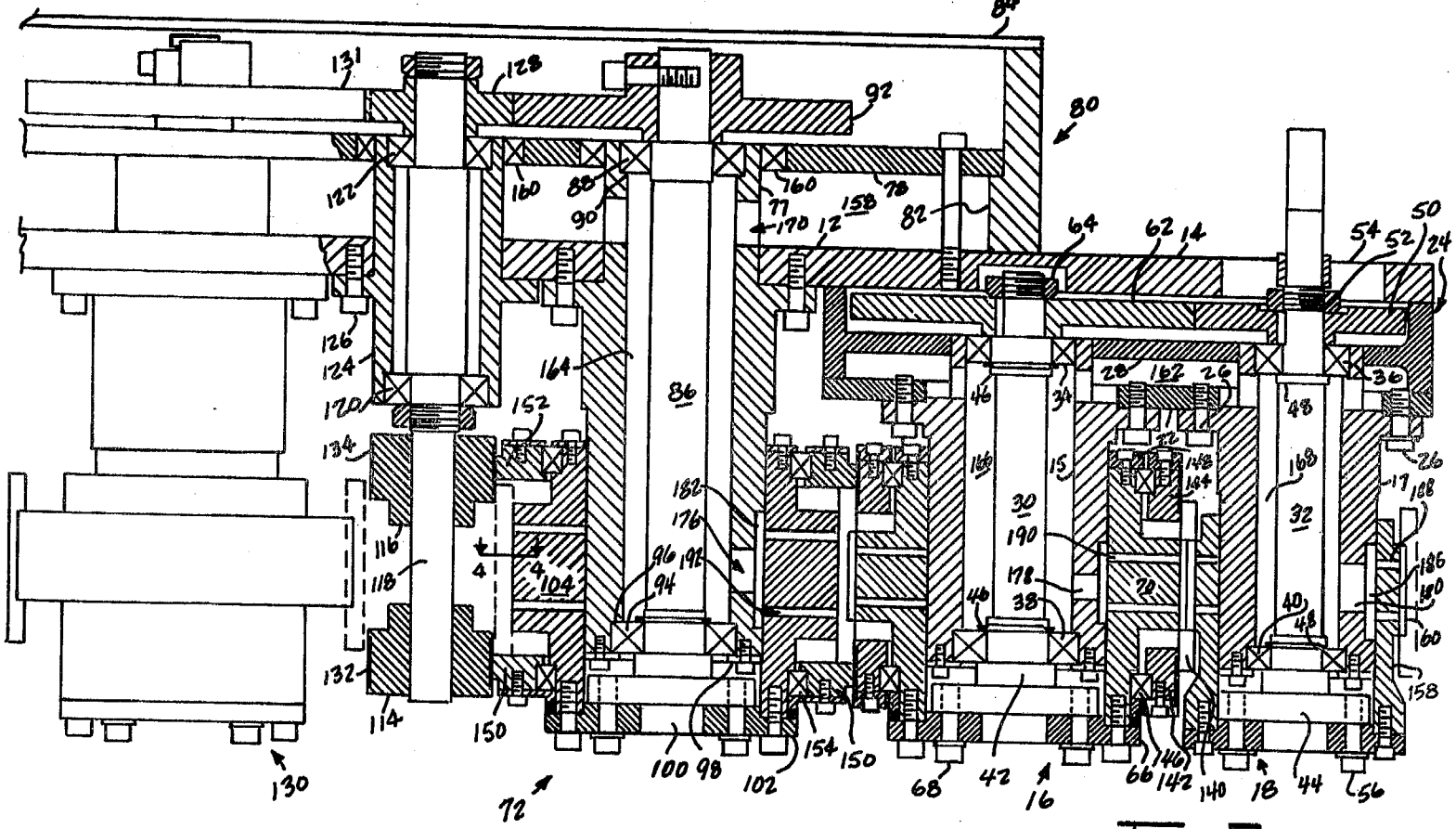
FIG. 2 is a conventional revolved section view taken along Lines 2—2 of FIG. 1.

In FIGS. 1 and 2, it can be seen that retaining belts 132 and 134 will engage pulleys 114 and 116, respectively, and extend substantially around the transfer drum 16, contact the drum initially just prior to the transfer point 133 between output drum 18 and transfer drum 16 and losing contact with the transfer drum slightly past the transfer point X between drums 16 and 72. The belts engage approximately a quarter of phasing drum 72 from point X to point Y where pulleys 114 and 116 contact the phasing drum. Belt tighteners 136 mounted on mounting plate 12 are used to maintain the proper tension on the belts. At the point 133 of transfer between output drum 18 and transfer drum 16, the belt is already in contact with the transfer drum, thus, the belt is located below the rod-shaped articles 140. The belts engage annular pulley rings 142 and 144 (see FIG. 2) which are carried on annular bearings 146 and 148 that are, in turn, carried on the outside surface of the seat sleeve 70, thus, the pulley rings will rotate independently of the sleeve.

At the transfer point X, the retaining belts are reoriented with respect to the rod-shaped articles as they pass from a position below the rod-shaped articles to a position above the rod-shaped articles, by passing from annular pulley rings 142 and 144 to belt spacer rings 150 and 152 located on opposite sides of the seat portion 104 of sleeve 102 of the phasing drum 72. The belt spacer rings maintain the belts at a selected distance, normally slightly less than the diameter of the rod-shaped articles from the outer surface 153 of the seat sleeve 104 of the phasing drum 72 (see FIG. 3).

In this preferred embodiment, where the transfer and phasing apparatus is used with cigarettes, the distance between the belts and the surface 153 of seat portion 104 is between 0.13 mm to 0.38 mm less than the diameter of the cigarettes. This distance was determined by experimentation and, although it is appropriate for filter cigarettes, it might vary with respect to other articles made of different materials. The spacing rings are carried on annular bearings 154 and 156 which are secured to the sleeve 104 similarly to the pulley ring bearings 146 and 148.

The vacuum for drums 16 and 18 differ from the vacuum for drum 72 in flow rate and pressure, though the construction of the drums to transmit the vacuum is generally the same and standard in the art.

A vacuum chamber 158 is maintained for drum 72 between mounting plates 12 and support plate 78 by seals 160 surrounding housings 174 and 124 which extend through the cover plate 78 while another vacuum chamber 162 is maintained for drums 16 and 18 between cross plate 28 and top plate 22 of the support housing 24. These vacuum chambers are connected to a vacuum source in the usual manner known in the art and communicate with annular spaces 164, 166 and 168 between the housing and the shafts of drums 72, 16 and 18, respectively, through apertures 170, 172 and 174 in the housings.

Grooves or recesses 182, 184 and 186 are formed in the outer surfaces of the housings 74, 75 and 17, respectively, and extend a selected angular distance which is determined by the transfer points of each drum. Each of the sleeves 58, 66 and 102 in their seat portions have a pair of bores 188, 190 and 192 extending generally perpendicular to the axis of the sleeves at each seat or pocket. The sleeve bores transmit the vacuum or negative pressure to the seat when the bores pass into the housing grooves as the sleeve rotates.

Turning now to the operation of the transfer and phasing apparatus. The retaining belts 132 and 134 and the transfer drum 16 are driven in a clockwise direction while the phasing drum rotates in a counterclockwise direction so that, as the belts come in contact with the spacer rings of the phasing drum, the belts and the drum are moving in the same direction. The speed of the belts is maintained slightly less than the peripheral speed of the phasing drum 72. The difference in speed is equal to one (1) phasing distance A. In other words, between points X and Y, the rotational distance, a point on belt 134 (see FIG. 3) which corresponds with the trailing edge 110 of a particular pocket 106 at point X will be one phasing distance behind that same trailing edge when the trailing edge reaches point Y. This can be accomplished by determining the peripheral speed of the drum and sizing the gears accordingly. The phasing distance or pitch is determined by the pitch input drum 130 in the normal manner. The configuration of the tapered pocket 106 is of particular importance as the speed at which the transfer is being made is increased. As can be easily understood, at slow speed, the configuration would not be as important because the centrifugal force on the rod-shaped articles would be low. Another factor which determines the configuration of the tapered pocket is the flow rate and the pressure of the vacuum.

Through experimentation, the preferred pocket configuration can be determined. When transferring filter cigarettes, the preferred embodiment is illustrated in FIG. 4 and the dimensions of this configuration are based on several factors including a vacuum or negative pressure of 18.8 to 28.2 mm/Hg, a flow rate of 0.283 to 0.373 $m^3$/sec. and a product rate on the transfer drum of 1 to 5,000 units per minute and on the phasing drum of up to 5200 units per minute. The product rate is the number of products carried on the drum past a given point per one minute of time. As, for example, with the phasing drum distance A of 19.05 mm and a pocket radii of 4.19 mm, the interference zone B would be 5.59 mm and the release zone C would be 8.27 mm while the angle of taper E would be 75°. By utilizing the above dimensions, a small ridge 192 (see FIG. 4) is formed between the incline plane and the edge of the bore 194.

With this configuration, it has been found that a transfer can be made while the transfer drum is operating at a product rate of 1 unit per minute to 5,000 units per minute and the phasing drum operating at the product rate of up to 5200 units per minute. Furthermore, when operating at the maximum speeds, only one unit per 20,000 units does not make the transfer. It should be understood that the above specification and dimensions may vary depending upon the article to be transferred as well as the pitch of input drum 130.

Continuing with the operation of the apparatus, as previously mentioned, the distance between the belts and the drum surfaces is slightly less than the diameter of a cigarette so that the belt will contact the rod-shaped articles in the interference zone B. In the interference zone, a clockwise rolling movement is imparted to the rod-shaped articles due to the contact with the slower moving belts, thus, causing the cigarettes to move towards the pocket 106.

When the article moves out of the interference zone B into the release zone C, the tapered leading side of the pocket produces an increased space between the drum and the belt so that the article is no longer contacted by the belts. At this point, the rod-shaped article also comes under the influence of the air flow of the vacuum in the release zone D. Rod-shaped articles enter the phasing drum at any point within the phasing distance A because the drive independency of the transfer drum 16 and phasing drum 72 causes random location of the products on the phasing drum 72. If the rod-shaped article enters the phasing drum in interference zone B, the belts retain the article on the drum and the differential speed between the belts 132 and 134 and drum 72 will cause movement of the product of the rod-shaped article towards the pockets 106 where it will be captured. If the articles enter in the release zone B, the clearance between the belts and the rod-shaped article allows the air flow through the vacuum seats to affect movement of the cigarettes into the pockets. All of the articles are seated in a pocket when they reach point Y on the phasing drum, thus, the articles are in phase with the pockets of the input drum 130. As the belts terminate contact with the phasing drum at the drive pulleys, the articles are held in the pockets 106.

Figure 5:
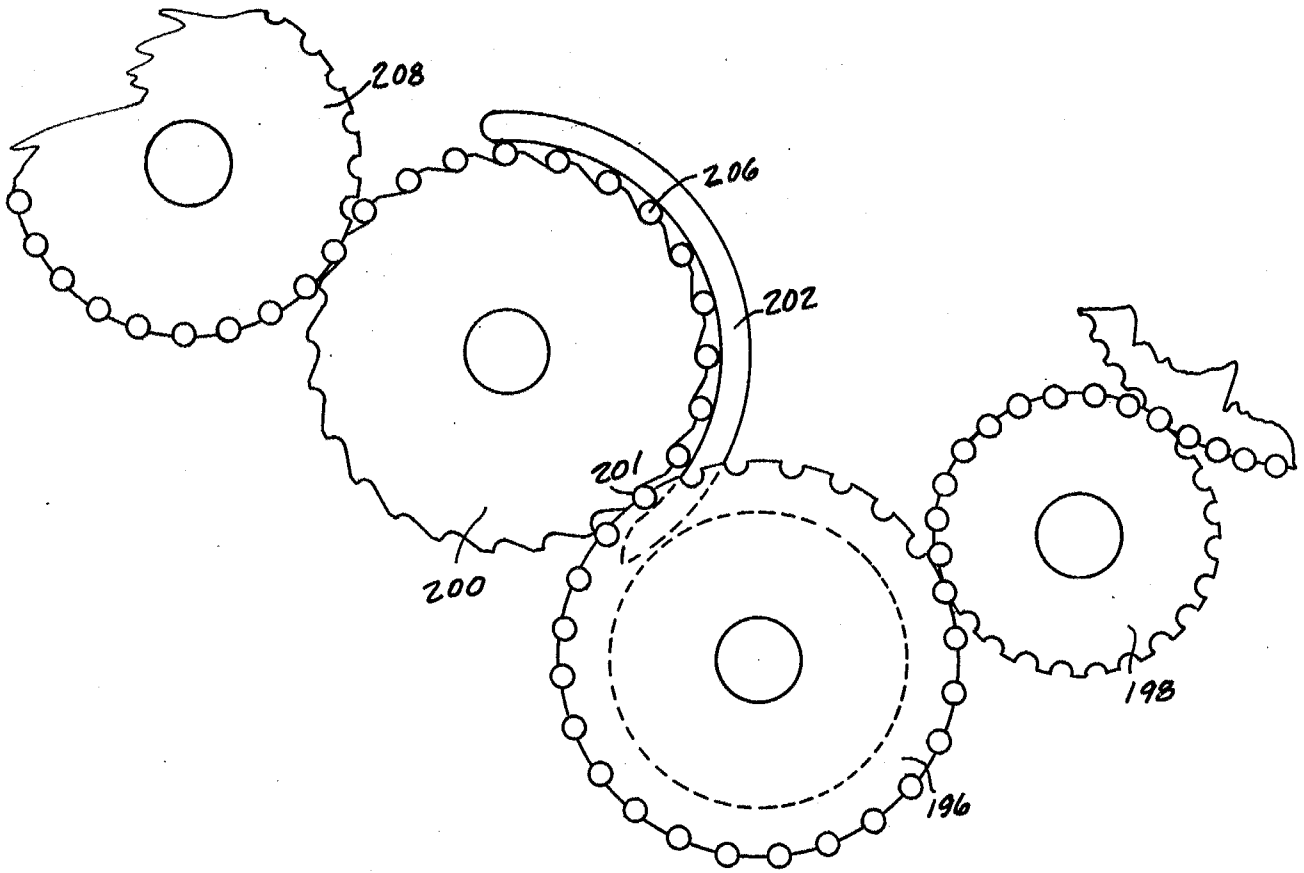
FIG. 5 is a front schematic view of another embodiment of the transferring and phasing device according to the present invention.

FIG. 5 illustrates another embodiment of the present invention which can be utilized to transfer and phase rod-shaped articles when the product rate speed is about 2,000 units per minute. A transfer drum 196 receives the rod-shaped articles from output drum 198, both of which are driven at the same peripheral speed. The articles are transferred from the transfer drum to a phasing drum 200 in a manner similar to the operation previously described, however, instead of utilizing a moving belt, a stationary guide or retaining rail 202 is used. The stationary rail extends within the perimeter of the transfer drum 196 to a point past the point of transfer 204 between the transfer and phasing drums. The rails extend a selected distance around the periphery of the phasing drum which can be easily determined through experimentation. Because the stationary guides engage the rod-shaped articles abruptly, there is a possibility in this embodiment that the rod-shaped articles can be damaged if the unit is operated at high speeds beyond 2,000 units per minute. Any out-of-phased articles which are transferred from the transfer drum to the phasing drum are moved clockwise by the guide rail until they are captured by the negative pressure of the phasing drum and held and moved to the pockets 206. The articles are transferred to an input drum 208 which has seats the same pitch as the phasing drum and which is rotating at the same peripheral speed. Although FIG. 5 shows a transfer drum, it should be understood that, if the existing output drum 198 has the proper configuration to permit rails 202 to extend within its perimeter, the transfer drum 196 can be eliminated.

It can be seen from the above description and drawings, that this transfer and the phasing mechanism can be utilized to transfer rod-shaped articles between conveying drums with a differential in their peripheral speed and which are not synchronized. The phasing and transfer apparatus will also permit one machine to run at a constant speed while permitting the other machine to run from zero to an equivalent speed of the first machine, thus permitting a first and second machine to be driven by two different sources and permitting the second machine to continue operations even if the first machine encounters a stoppage.

This preferred embodiment can be modified in various ways, such as changing the particular drive mechanisms or the methods of journaling the shafts of the configurations of the various drums, however, these types of variations can be made to the subject invention without departing from the true spirit of the invention as defined in the following claims.

I claim:

1. Apparatus for phasing and transferring rod-shaped articles between independently drive first and second non-synchronous conveying drums, comprising:

(a) transfer drum means for receiving the articles from the first conveying drum, said transfer drum being synchronized with the first conveying drum and operating at speeds variable from zero to a specified maximum;

(b) phasing drum means contiguous to said transfer drum, said phasing drum being synchronized with the second conveying drum and rotating at a constant peripheral speed which is greater than the maximum speed of said transfer drum;

(c) seat means located on said phasing drum, having areas in which to capture and retain the rod-shaped articles; and (d) means for capturing and transferring the rod-shaped articles, said transfer means including driven belt means moveably mounted adjacent to said transfer and phasing drum for moving the articles off of said transfer drum, capturing the articles on said phasing drum, and urging the articles into said seats.

2. The apparatus of claim 1, wherein said seat means comprises:

(a) tapered leading edges for rolling the rod-shaped articles toward a conveying position;

(b) fluted pockets for conveying the articles; and (c) surfaces, substantially flat, for capturing the articles, said surfaces being located between said pockets and related in size to the diameter of the articles.

3. The apparatus of claim 1, wherein said transfer means further includes means for applying a negative pressure to said seats to assist in capturing the articles and retaining them in said seats prior to transfer to the second conveying drum.

4. The apparatus of claim 1, wherein said belt means is spaced a selected distance from the surface of said phasing drum, said distance being slightly less than the diameter of said rod-shaped articles, and said belt means is located adjacent said phasing drum for a selected arc distance.

5. The apparatus of claim 1 or 3, wherein said belt means moves in the same direction as the peripheral surface of said phasing drum at a selected lower speed.

6. The apparatus of claim 1, 2 or 4, wherein said belt means includes:

(a) an endless belt contacting and circumscribing a portion of said transfer drum means, said belt contacting said transfer drum prior to the transfer of the rod-shaped articles from said first conveying drum so that said belt is located below the rod-shaped articles while on said transfer drum, said belt contacting said phasing drum means at about the transfer point of said rod-shaped articles from said transfer drum means to said phasing drum means so that the belt is located above said rod-shaped articles while the belt is in contact with the phasing drum; and (b) pulley means located adjacent said phasing drum for engaging said belt to drive said belt in the same direction of movement as the peripheral surface of said phasing drum at a selected lower speed.

* * * * *